United States Patent [19]

Stoll, III

[11] Patent Number: 4,500,007

[45] **Date of Patent: * Feb. 19, 1985**

[54] PARROT-BEAKABLE FREESTANDING PLASTIC DRUM ASSEMBLAGE FOR HANDLING HEAVY MATERIALS

[75] Inventor: Andy J. Stoll, III, Toledo, Ohio

[73] Assignee: Owens-Illinois, Inc., Toledo, Ohio

[ * ] Notice: The portion of the term of this patent subsequent to May 20, 1997 has been disclaimed.

[21] Appl. No.: 212,790

[22] Filed: Dec. 4, 1980

Related U.S. Application Data

[63] Continuation of Ser. No. 113,016, Jan. 18, 1980, abandoned, which is a continuation of Ser. No. 879,841, Feb. 22, 1978, Pat. No. 4,203,526, which is a continuation of Ser. No. 636,264, Nov. 28, 1975, abandoned, which is a continuation of Ser. No. 635,206, Nov. 25, 1975, abandoned.

[51] Int. Cl.[3] ..... B65D 1/46; B65D 6/34; B65D 25/22

[52] U.S. Cl. ..... 220/71; 220/5 R; 220/69; 220/73; 220/DIG. 1

[58] Field of Search ..... 220/69, 71, 5 A, 5 R, 220/73, DIG. 1

[56] References Cited

U.S. PATENT DOCUMENTS

| | | | |
|---|---|---|---|
| 104,885 | 6/1870 | Reynolds | 220/69 |
| 206,614 | 7/1878 | Reynolds | 220/69 |
| 1,683,788 | 9/1928 | Mausen | 220/71 |
| 3,249,271 | 12/1966 | Armburster | 220/5 R |
| 3,370,737 | 2/1968 | Ainslie | 220/5 R |

FOREIGN PATENT DOCUMENTS

| | | | |
|---|---|---|---|
| 600094 | 3/1948 | United Kingdom | 220/73 |
| 847354 | 9/1960 | United Kingdom | 220/85 P |

*Primary Examiner*—George E. Lowrance
*Attorney, Agent, or Firm*—Thomas L. Farquer; M. E. Click

[57] ABSTRACT

There is provided a plural part freestanding receptacle assemblage for storage and handling of bulk quantities of material which comprises a plastic drum and handling means concentrically and holdingly assembled about the drum grippable by chime-handling devices to enable transportation and movement of the receptacle by such devices; the drum includes a substantially circumferentially disposed reentrant portion having an upper ledge portion disposed substantially perpendicular to the longitudinal axis of the drum and the handling means includes a lug-like, substantially circumferential, inwardly extending portion inserted into the reentrant portion of the drum, the inwardly extending portion of the handling means includes an upper shoulder portion disposed substantially parallel to and immediately below and generally in contact with the ledge portion.

2 Claims, 5 Drawing Figures

PARROT-BEAKABLE FREESTANDING PLASTIC DRUM ASSEMBLAGE FOR HANDLING HEAVY MATERIALS

This application is a continuation of application Ser. No. 113,016 filed Jan. 18, 1980, now abandoned, which is a continuation of application Ser. No. 879,841 filed Feb. 22, 1978, now U.S. Pat. No. 4,203,526 issued May 20, 1980, which is a continuation of Ser. No. 636,264 filed Nov. 28, 1975, now abandoned which in turn is a continuation of Ser. No. 635,206, filed Nov. 25, 1975, now abandoned.

CROSS REFERENCES TO RELATED APPLICATION

The present application is related to application U.S. Ser. No. 636,272, filed on Nov. 28, 1975, now abandoned.

The present invention is directed to the art of materials handling and, more particularly, is directed to freestanding plastic drums. Even yet more particularly, the invention is directed to an improved plural part assembly of a plastic tight-head drum fabricated of an organic polymer and handling means assembled to the drum which allows the receptacle and drum to be handled with conventional steel drum chime-handling devices. Still more particularly, the present invention is directed to an improved assemblage which allows for the safe and reliable handling of materials which are heavier than water.

Largely because of the long time usage of steel drums for handling bulk quantities of material, standard equipment has been developed to handle such drums by gripping the chime thereof in order that the drums may be transported and moved. That type of standard equipment is generally recognized, and referred to in the art, as steel drum chime-handling devices or, simply, chime-handling devices. One type of chime-handling device which has wide utility is referred to in the art as a parrot-beak device or, occasionally, as a cherry picker and one such device is sold by the Little Giant Company under the designation Grip-O-Matic. This type of device includes two opposed pivotal, or movable, jaws or beaks which, when brought into contact with a chime on a drum are adapted to open so as to allow them to be positioned with the chime between them and, upon lifting of the drum, the chime is lockingly gripped between the jaws or beaks allowing for movement and transportation. Other chime-handling devices, such as those referred to as a chime-grabber, and hand truck, likewise include a beak, or jaw, or hook, to exert a localized force on the chime which allows for the drum to be tilted and then appropriately moved. Thus, as used herein the term "chime-handling" devices or equipment refers to the above type equipment and the term "parrot-beak" device likewise refers to the parrot-beak chime-handling equipment of the type indicated above.

In the above-referred to related application Ser. No. 636,272, which is hereby incorporated by reference, there is described a freestanding plastic drum assemblage, i.e., a receptacle which is put together, or assembled, from a prefabricated drum and handling means, such as for example a ring or collar, which assemblage, and more accurately the handling means assembled to the drum, can be gripped for movement and handling by chime-handling devices. That application also describes drainage features on the receptacle and a removable feature of the handling means, both of which provide many and numerous benefits to the assemblage. In that application it is also shown that the drum has a recess or reentrant portion into which an inwardly extending portion of the handling ring or drum is inserted. In the course of the development of the assemblage therein described it was found that, generally, the inwardly extending portion of the handling means and the recess portion of the drum into which that portion was inserted operated quite satisfactorily for water-weight materials, i.e. those having a specific gravity about that of water. However, when handling materials which were heavier than water, for example materials in quantities of about 50 gallons to 60 gallons having a specific gravity of about two, it was surprisingly found that, when the receptacle was handled in quite a violent and rough manner with parrot-beak devices a specific configuration was required.

Thus, in accordance with the present invention, there is generally provided an improved assemblage of a drum and handling means which allows one to handle the receptacle, or assemblage, quite roughly and violently in a safe and reliable manner for transporting bulk quantities of materials especially materials which are heavier than water, for example, those having a specific gravity of around two. For purposes of clarity when the term assemblage, or assembly, or the like, is employed this contemplates the installation of the handling means onto a plastic drum subsequent to the formation of the drum, or at least a major component thereof; i.e., the handling means are put onto the drum subsequent to the drum, or a major component thereof like a body portion, being fabricated by its forming process, for example, a blow molding forming process. This is in contrast to inserting ring members into a mold and permanently attaching such ring members during fabrication of the drum. Likewise when used herein the term removable is used in contrast to a permanent attachment as, for example, which results if the handling means are spin welded or adhesively secured to the drum or formed in the drum during molding.

German Gebrauchsmuster No. 74 12047 discloses the insertion of rings into a drum by insertion of rings into the mold but does not describe an assembly, or assemblage, and does not recognize the present invention. German Offenlegungsschrift No. 23 29 246 is directed to permanently attaching rings to a drum by either rotational, or spin welding, or by the use of appropriate adhesives, and it is further indicated that rings anchored into recesses of drums are unsatisfactory. Hence there is no recognition of the present invention therein. *Modern Packaging*, March 1975, at page 47 photographically and obscurely purports to illustrate a drum with galvanized steel bands to enable shipping of heavy products. Similarly, *Chemical Week*, July 2, 1975 pages 18 and 19 obscurely mentions a metal ring around a drum to facilitate lifting.

U.S. Pat. No. 1,909,028 relates to a metallic shipping and storing vessel which has protective rings or bumpers retained in permanent engagement with the vessel. The rings have an annular portion to facilitate grasping and are provided with safety features for handling with the palms of the hands. There is no description of the present invention therein.

U.S. Pat. No. 3,889,839 discloses discrete indentations in a drum for forklift handling and also a handling attachment adjacent the bung. The deficiencies thereof especially because of the exertion of strong localized forces on the bung will be readily apparent.

Referring generally to the drawings.

Figure 1:
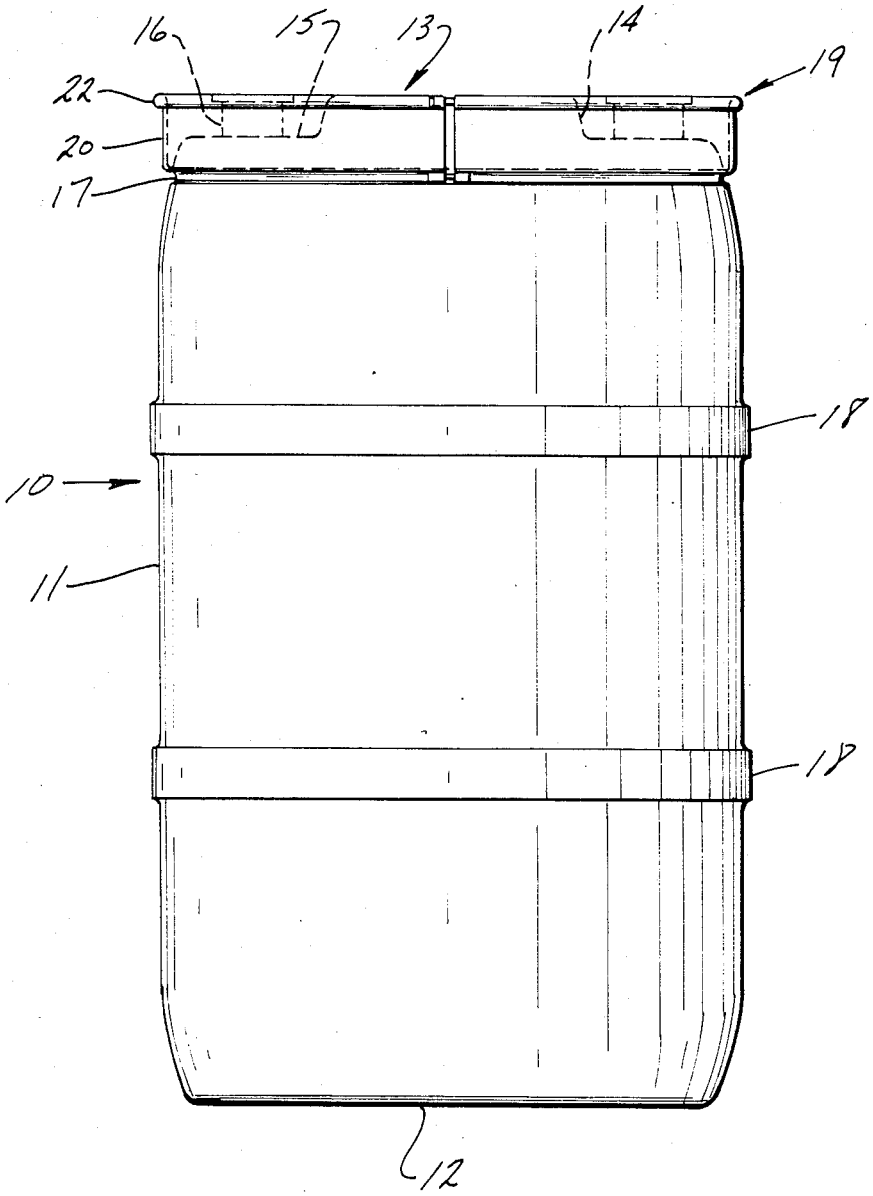
FIG. 1 is a side view of the contemplated receptacle assembly of a drum and handling means.
Figure 2:
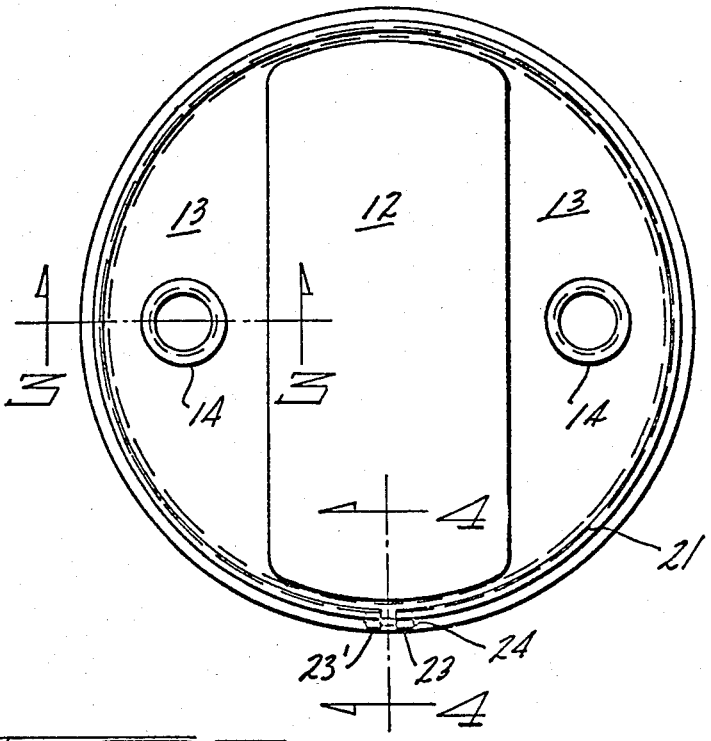
FIG. 2 is generally a top view of the contemplated receptacle assembly.
Figure 3:
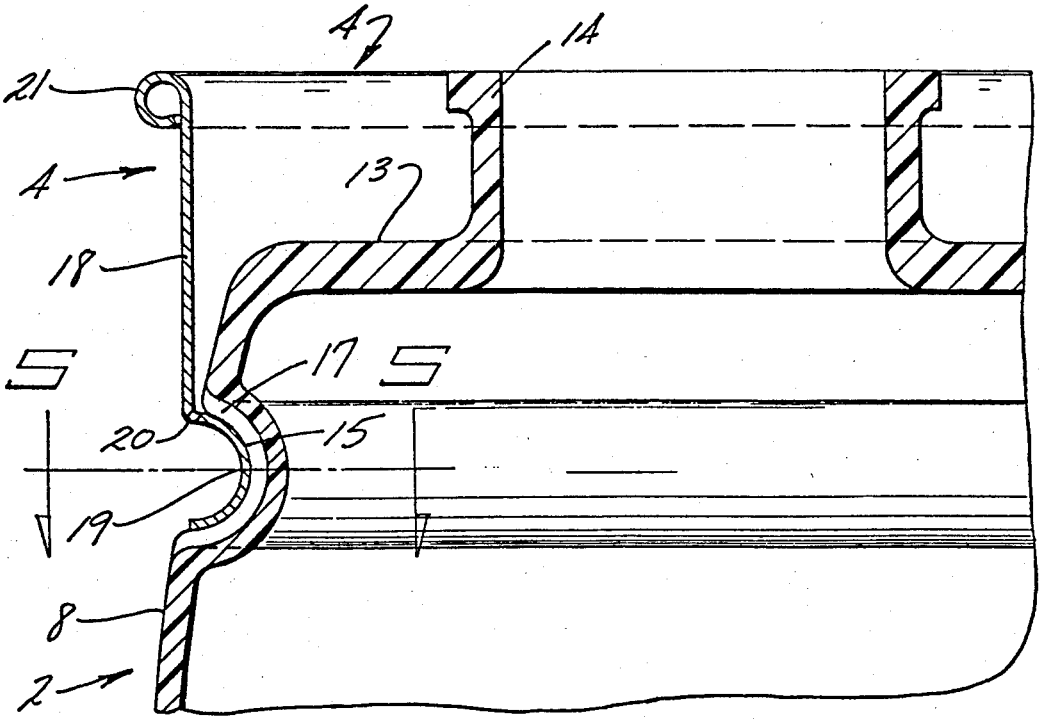
FIG. 3 is a fragmentary sectional view generally along line 3—3 of FIG. 2 more clearly showing important features of the invention.
Figure 4:
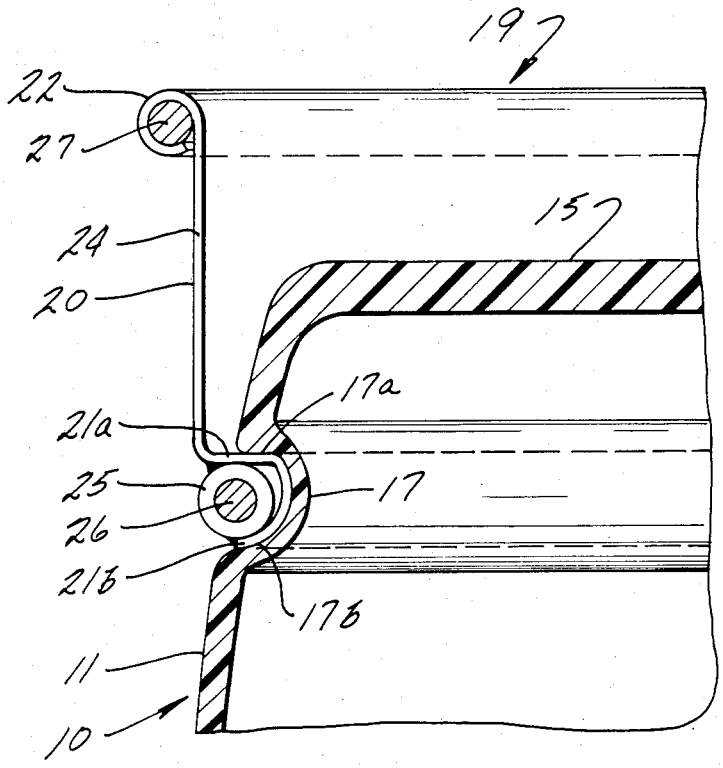
FIG. 4 is a fragmentary view generally along part of line 4—4 of FIG. 2.
Figure 5:
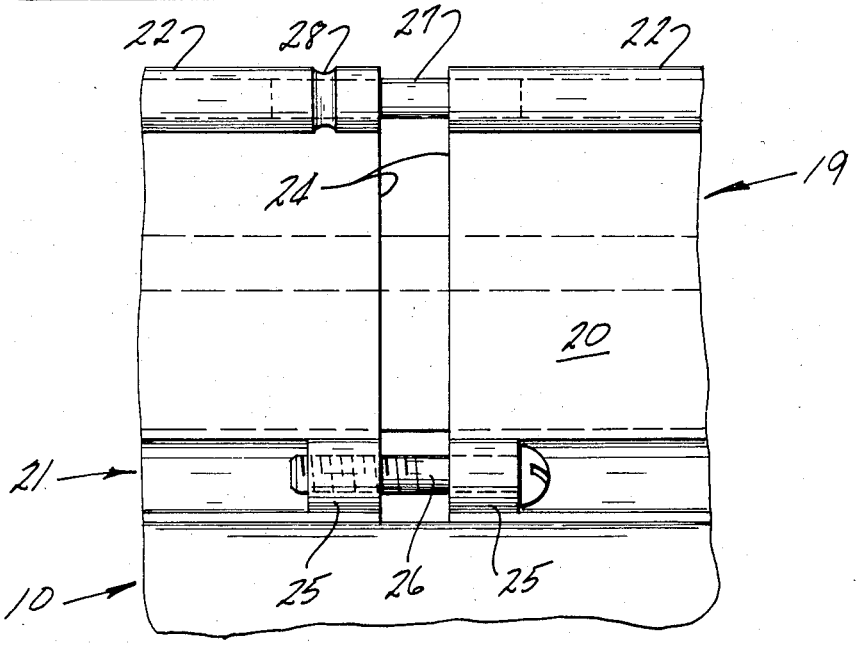
FIG. 5 is a side view more clearly showing portions of the handling means.

Referring now, more specifically, to the drawings there is shown a freestanding receptacle assembly for the storage and handling of bulk quantities of material which receptacle assembly can be safely and reliably handled in a violent and rough manner with materials which are heavier than water. For example, no difficulties are encountered when handling materials having a specific gravity of about two in volumes on the order of 50 to 60 gallons. The receptacle assembly includes a drum 10 and handling means which are grippable by chime-handling devices to enable transportation of the receptacle by such devices and, especially, by parrot-beak devices. These handling means are generally illustrated as a split collar 19 which is concentrically assembled onto the drum, i.e., put onto the drum after the drum has been manufactured. Drum 10 is generally of cylindrical configuration and includes a circumferential sidewall 11 which merges, in a slight tapering fashion, at a lower margin thereof with a bottom end 12. At its upper margin, circumferential sidewall 11 merges, again with a slight taper, with the drum top, generally 13. Drum top 13 includes a raised central panel 14 which merges with opposed depressed sections 15. Depressed sections 15, on opposite sides of raised panel 14, are provided with an upwardly extending tubular projection 16 which serves to define a mouth opening into drum 10 to allow for the filling of the drum with bulk quantities of materials and likewise the removal of same from the drum. Of course, as will be apparent upwardly extending tubular projection 16 will be provided with appropriate closure means not shown. Circumferential sidewall 11 includes two circumferential projecting rib portions 18 which are displaced along the longitudinal axis of the drum, and which function in the manner of rolling hoops. Approximately 1 to 3 inches or so beneath depressed section 15, sidewall 11 includes a substantially circumferential recess or reentrant portion 17. Reentrant portion 17 includes an upper ledge 17*a* disposed substantially perpendicular to the longitudinal axis of the drum and upper ledge portion 17*a* preferably merges with a lower arcuate portion 17*b*. In the preferred embodiment, drum 10 is fabricated as a single piece article by a molding operation, for example a blow molding operation, and is made of high density polyethylene with a minimum wall thickness on the order of about 0.125 inches and, preferably, in the range of about 0.130 to about 0.150 inches. Such a plastic drum, which is molded as a single piece article, has many advantages most notably, and as will be apparent from the drawings, that there are no seams, seals, or sealing surfaces, between the sidewall 11 and the top end 13; hence, in utilization there are no difficulties with leakage. Put onto the drum, after it has been fabricated as a single piece article, are the handling means which are grippable by parrotbeak chime-handling devices to enable transportation of the receptacle. The handling means, generally shown in the form of split collar 19, includes a substantially axially, or vertically, elongate wall 20 which wall merges at its lower margin with an inwardly extending portion 21, which is lug-like, and which is positioned within the recess or reentrant portion 17 of drum 10. Inwardly extending portion 21 includes an upper shoulder portion 21*a* which merges with a lower arcuate portion 21*b*. The dimensions of inwardly extending portion 21 and the recess or reentrant portion 17 are preferably such as to provide for a snug fitting inter-engagement thereof. As will be seen upon positioning collar 19 onto drum 10, shoulder portion 21*a* is disposed substantially parallel and immediately below upper ledge 17*a* and generally in substantially snug contact therewith. Quite suitable results will be obtained by having ledge 17*a* and shoulder 21*a* which are substantially planar. Vertical wall 20 merges at its upper margin with a substantially circumferential bead-like portion 22. Bead-like portion 22 as shown will conveniently be hollow and functions to allow collar 19 to be gripped by the opposing jaws of parrot-beak devices. Of course, other configurations other than the bead-like configuration can be employed; generally however what will be required is to have some laterally projecting surface portions which will allow for engagement of the opposed jaws of parrot-beak devices.

While, as indicated above, the handling means or collar is a split collar, if desired, the collar can be substantially continuous and the collar press fitted over the drum to bring the inwardly extending portion 21 of collar 19 into tight snug holding relationship by inter-engagement with the recess or reentrant portion 17 of drum 10. In either instance the collar is removable for replacement and interchangeability of parts without substantial drum destruction as would occur if the collar were permanently attached as by the use of rivets or chemical bonding, e.g. by spin welding. For convenience and ease of removal, however, it is generally preferred that the collar be a split collar and that it be provided with means, preferably releasable and adjustable means, for tightening the collar about the drum. In this way inwardly extending portion 21 and reentrant portion 17 are conveniently brought and maintained in an engaged relationship sufficient to enable safe and reliable movement and transportation of the receptacle by chime-handling devices. Any suitable means for tensioning the collar may be employed. Conveniently, as indicated in the drawings in the open area of split collar 19, i.e., adjacent opposed edges 24 of collar 19 and carried by the externally disposed surface of inwardly extending portion 21, i.e. in the concavity of portion 21, are a pair of opposed and aligned bushings 25, at least one of which is internally threaded, which bushings are suitably secured to the external surface such as, for example, by welding. A screw designated 26 passes through tubular flanges 25 whereby, upon tightening thereof collar 19 is tensioned and portion 21 is brought into a holding nested relationship with reentrant portion 17. Preferably, for example using a 5/16 inch screw with 18 threads per inch, the screw will be tightened to a torque of at least about 50 inch × pounds and most desirably about 100 inch × pounds or higher. Upon releasing screw 26 the convenient and easy removal of split collar 19 from drum 10 may be accomplished. Additionally, in a quite convenient mode of practicing the present invention when employing a split collar, a rod member 27 will generally be employed which is positioned in the hollow opening of bead-like portion 22 and spans the open area of the split collar between the opposed edges 24. Suitably rod 27 will be holdingly secured into bead-like portion 22 by any suitable means such as by crimping of the bead-like member about the rod as generally indicated at 28. In this way enhanced structural stability of the upper portion of collar 19 is achieved. Additionally, in order to provide against the accumulation of liquids between collar 19 and drum 10 the receptacle assemblage will be provided with means for preventing such accumulation. Suitably such means comprises a drainage channel 23 formed in collar 20 adjacent, i.e. at or near, the junction of shoulder portion 21*a* and wall 20. Most desirably a plurality of such drainage channels will be provided, e.g., at least 2 diametrically opposed channels and quite suitably 3 or more such drainage channels 23 will be provided in a relatively uniform angular or circumferential array. If desired drainage channels can also, or alternatively, be provided in the drum reentrant portion in the manner generally illustrated in the aforementioned incorporated copending application.

In the preferred embodiment of this invention collar 19 will extend axially upwardly to a sufficient degree such that the upper margin, for example, the upper surface of bead-like portion 22, is generally disposed at a level which is at least flush with the upper portion of upwardly extending tubular projection 16 and may be slightly higher than such projection in order to provide protection thereof during handling, stacking, and the like.

As will be seen from the drawings the collar is separate from the drum. By having such a collar which is so arranged and constructed that the parrot-beak jaws contact it and not any portion of the drum there is virtually no danger whatsoever of pinching holes in the drum, which could cause leakage problems, inasmuch as the clamping and pinching action of the parrot-beak devices are exclusively upon the collar. Additionally the assembly of the collar to drum sidewall serves to distribute loading over a wide area which provides enhanced structural characteristics. As indicated in the drawings only a single substantially circumferential inwardly extending portion 21 on the ring and a single substantially circumferential recess or reentrant portion on the drum is required to achieve quite desirable and satisfactory handling of the receptacle assembly, i.e., it will be found that there is no need to provide a plurality of such substantially circumferential reentrant portions spaced longitudinally on the sidewall of the drum nor a plurality of inwardly extending portions axially disposed on the collar or handling means.

Generally it is preferred that the collar member, or handling means, be of a metal such as for example sheet metal, like cold rolled sheet steel and that the thickness, for example, of the wall, and the inwardly extending portion be on the order of at least about 0.04 inches. Quite suitably the metal collar will be manufactured from, for example, a 16 or 18 gage cold rolled steel.

In order to assist those skilled in the art to appreciate the significance of the present invention and to even yet more particularly to enable those skilled in the art to make and use the present invention two general examples follow.

A split collar member of the type illustrated in the drawings was manufactured from 18 gage cold rolled steel in which the vertical wall 20 of the collar merged, through a slight radius, into a substantially flat planar shoulder 21*a* which was perpendicular to the longitudinal axis of the drum. This shoulder in turn merged, through a small radius, to an arcuate portion 21*b* which arcuate portion was generally designed on a $\frac{3}{8}$" radius. Generally, the length of the shoulder along its planar portion, discounting any small radius curves as to where it merges with the vertical wall, or with the lower arcuate section, was on the order of about 5/16 ". Additionally the height of the inwardly extending portion, i.e., the height from the top of the shoulder to the lower most portion of the lower arcuate portion was on the order of $\frac{5}{8}$". Additionally a high density polyethylene drum was manufactured having a circumferential recess 17 of the type illustrated in the drawings; the dimensions and configuration of the recess were such that the outwardly disposed surfaces of the recess were substantially congruent with the inwardly disposed surfaces of the inwardly extending portion 21 of the collar. When assembled the distance from the inside surface of wall 20 to the outside surface of the drum wall when measured generally along the plane of the upper surface of shoulder 21*a* was about 5/32 ". In contrast another split collar member was manufactured but instead of employing the configuration of the inwardly extending portion as described above, i.e., one possessed of a generally planar shoulder merging with a lower arcuate portion, the inwardly extending portion was totally arcuate and more specifically was approximately a semi-circle with a $\frac{3}{8}$" radius. Similarly another drum was manufactured wherein the recess portion, instead of being possessed of an upper ledge 17*a* merging with a lower arcuate portion 17*b* was likewise totally arcuate and dimensioned so as to be substantially congruent with the totally arcuate inwardly extending portion of the collar. Both collars, using 5/16" screws with 18 threads per inch, were tightened to a torque of about 100 inch×pounds. Both assemblies, when employing a nominal 55 gallon capacity drum with water in the drums, operated quite satisfactorily when handled and moved with a parrot-beak chime-handling device. In another run each of the drums were filled with a charge of water and sand to produce a receptacle having a total weight on the order of approximately 825 pounds and a parrot-beak chime-handling device was similarly employed to handle such receptacles. The receptacle, wherein the collar and drum were provided with the shoulder and ledge disposed substantially perpendicular to the longitudinal axis of the drum when violently handled with the parrot-beak device showed excellent operability, with no slippage of the collar from the drum resulting. In contrast, the assembly of the drum possessed of the totally arcuate recess and the collar having a totally arcuate inwardly extending portion operated unsatisfactory and exhibited collar slippage from the drum under handling conditions which were much milder than conditions under which the present invention was satisfactorily tested. Additionally in drop tests the assemblage having the shoulder and ledge perpendicular to the drum axis showed superior characteristics relative to the assemblage with the totally arcuate configuration.

I claim:

1. A plastic drum assembly comprising a single-piece molded plastic drum having a top end, a bottom end, and a circumferential sidewall merging with said top and bottom ends, said sidewall including a circumferential recess adjacent said top end, said recess having an upper horizontal flat ledge portion facing downwardly and disposed essentially perpendicularly to the longitudinal axis of said drum, and a removable circumferentially disposed collar mounted on said drum, said collar having a substantially circumferential inwardly extending projection adjacent its lower margin positioned within and engaging said circumferential recess, said inwardly extending projection including a horizontal upper flat shoulder surface disposed in snug contact with said flat ledge of said recess, said collar being out of contact with said top end to allow access for drum chime-handling devices, said collar having an annular bead disposed adjacent the top thereof, whereby said collar is grippable by steel drum chime-handling devices enabling lifting and transportation of said drum assembly.

2. A plastic drum assembly comprising a single-piece molded plastic drum having a top end, a bottom end, and a circumferential sidewall merging with said top and bottom ends, said sidewall including a circumferential recess, adjacent said top end, said recess having an upper horizontal flat ledge portion facing downwardly and disposed essentially perpendicularly to the longitudinal axis of said drum, and a removable press-fit continuous circumferentially disposed collar mounted on said drum, said collar having a substantially circumferential inwardly extending projection adjacent its lower margin positioned within and engaging said circumferential recess, said inwardly extending projection including a horizontal upper flat shoulder surface disposed in snug contact with said flat ledge of said recess, said collar being out of contact with said top end to allow access for drum chime-handling devices, said collar having an annular bead disposed adjacent the top thereof whereby said collar is grippable by steel drum chime-handling devices enabling lifting and transportation of said drum assembly.

* * * * *

US004500777B1

REEXAMINATION CERTIFICATE (1851st)

United States Patent [19]

Drexler

[11] B1 4,500,777

[45] Certificate Issued Nov. 24, 1992

[54] HIGH DATA CAPACITY, SCRATCH AND DUST RESISTANT, INFRARED, READ-WRITE DATA CARD FOR AUTOMATIC TELLER MACHINES

[75] Inventor: Jerome Drexler, Los Altos Hills, Calif.

[73] Assignee: Drexler Technology Corporation

Reexamination Request:
No. 90/001,911, Dec. 21, 1989

Reexamination Certificate for:

| | |
|---|---|
| Patent No.: | **4,500,777** |
| Issued: | **Feb. 19, 1985** |
| Appl. No.: | **566,966** |
| Filed: | **Dec. 29, 1983** |

Related U.S. Application Data

[63] Continuation of Ser. No. 492,691, May 11, 1983, which is a continuation of Ser. No. 238,833, Feb. 22, 1981, abandoned.

[51] Int. Cl.[5] ..... G06K 19/00; G06K 1/00; G06K 7/10

[52] U.S. Cl. ..... 235/487; 235/382.5; 235/468; 235/488; 283/86; 283/904

[58] Field of Search ..... 235/379; 902/25, 27

[56] References Cited

U.S. PATENT DOCUMENTS

| | | | |
|---|---|---|---|
| 3,648,020 | 3/1972 | Tateisi et al. | 902/27 X |
| 3,795,902 | 3/1974 | Russell . | |
| 3,919,447 | 11/1975 | Kilmer, Jr. et al. | 428/138 |
| 3,947,661 | 3/1976 | Silverman et al. | 236/61.7 R |
| 4,114,027 | 9/1978 | Slater et al. | 235/379 |
| 4,216,501 | 8/1980 | Bell | 358/128.5 |
| 4,222,071 | 9/1980 | Bell et al. | 358/128.5 |
| 4,230,939 | 10/1980 | de Bont et al. . | |
| 4,245,152 | 1/1981 | Flurry et al. . | |
| 4,270,130 | 5/1981 | Houle et al. | 346/77 E |
| 4,380,769 | 4/1983 | Thomas et al. | 346/135.1 |

FOREIGN PATENT DOCUMENTS 55-4724 1/1980 Japan .

OTHER PUBLICATIONS

"Digital Recording, an optical system for high density information storage and retrieval" by Digital Recording Corporation, Wilton, CT (undated).

*Primary Examiner*—John W. Shepperd

[57] ABSTRACT

A data card having an optical, high resolution reflective laser recording material, such as a metallic film adhered thereon. The strip of laser recording material has a capacity for recording at least 250,000 bits represented by bits having a dimension less than 50 microns. The data card is used in electronic passbook banking or identification uses.

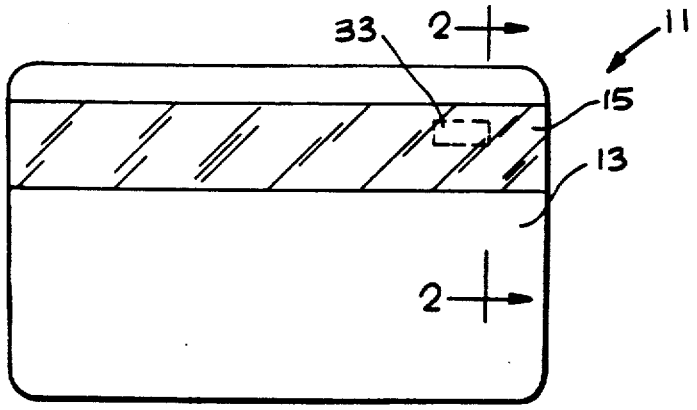

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been delected and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2 and 3, dependent on an amended claim, are determined to be patentable.

1. A system for sequentially recording transaction data by means of a laser comprising, a wallet size card with a transparent plastic laminating material protectively bonded to a strip of high resolution direct-read-after-write reflective laser recording material adhered to one side of the card being laser recordable in place on said card and having a minimal laser recording capacity of 250,000 binary bits, the reflectivity of said strip greater than 25% at near infrared wavelengths and having laser created pits therein, representing transaction data, with a dimension of between several microns and 25 microns and with reflectivity of less than 10%, and

*a plurality of stand alone terminal means independent of a central data store, said terminal means for reading and writing transaction data on a card whereby a card contains a complete record of previous transactions, each terminal comprising,* laser means having a beam disposed in laser writing relation with respect to said strip for writing said pits, representing transaction data, *said transaction data being data updating previously recorded data without erasing said previously recorded data,* the pits having a size of between several microns and 25 microns, [and]

a light detector means disposed in reading relation with respect to said strip for reading said pits, and means providing relative motion between the laser beam and the card for sequentially reading *previously recorded* transaction data on the card and *positioning the beam and the card for* writing transaction data onto said card in a permanent manner.

* * * * *